United States Patent [19]

Kazuo

[11] 4,134,167

[45] Jan. 16, 1979

[54] COMPOSITE PADDING MATERIAL

[75] Inventor: Nishiyama Kazuo, Tokyo, Japan

[73] Assignee: Sun Royal Co., Ltd., Tokyo, Japan

[21] Appl. No.: 801,838

[22] Filed: May 31, 1977

[30] Foreign Application Priority Data

Jun. 2, 1976 [JP] Japan ..... 51-071281[U]
Mar. 24, 1977 [JP] Japan ..... 52-036004[U]

[51] Int. Cl.[2] ..... B68G 5/00

[52] U.S. Cl. ..... 5/361 R; 5/345 R; 5/355

[58] Field of Search ..... 5/337, 355, 361 R; 428/6–15, 284, 286–287

[56] References Cited

U.S. PATENT DOCUMENTS

| | | | |
|---|---|---|---|
| 243,228 | 6/1881 | Doremus | 5/341 |
| 276,650 | 5/1883 | Weigel | 5/361 R |
| 696,343 | 3/1902 | Kelly | 428/188 X |
| 765,519 | 7/1904 | Sperry | 5/361 R |
| 1,703,629 | 2/1929 | Lange | 5/337 X |
| 1,928,806 | 10/1933 | Barcalo | 5/337 |
| 2,021,237 | 11/1935 | Karr | 5/355 |
| 2,087,505 | 7/1937 | Davis | 5/361 R |
| 2,831,532 | 4/1958 | Kasper | 5/337 X |
| 3,638,255 | 2/1972 | Sterrett | 5/337 |
| 3,892,909 | 7/1975 | Miller | 428/371 |

*Primary Examiner*—Henry F. Epstein
*Attorney, Agent, or Firm*—Kurt Kelman

[57] ABSTRACT

A composite padding material for use in bedding, garments or the like, said material comprising a filler layer of feathers and upper and lower plies of fibrous wadding over the opposite surfaces of said layer so that the barbs of outer feathers in the filler layer interlace with adjacent fibers in the wadding.

5 Claims, 5 Drawing Figures

COMPOSITE PADDING MATERIAL

This invention relates to a composite padding material used in bedding, garments or the like.

It has been heretofore practised to use feathers in beddings as a filler layer.

Heretofore, it has been proposed to provide a bedding or mattress sheathed with a quilted pouch or sack filled with a pad which consists of a plurality of chips of porous material such as polyurethanefoam, and feathers interlaced therewith. However, in bedding of this kind, the barbs of the feathers tend to intertwine with one another due to the nature of the feathers thus resulting in gathering in lumps and uneven distribution in use. A specifically processed cloth is required to prevent the barbs of the feathers from projecting from the bedding. This resulted in a poor appearance and less feeling.

It is, therefore, a primary object of the present invention to provide a novel and unique composite padding material simple in structure which eliminates the disadvantage of the prior art without necessity of any adhesive or bonding agent.

The present invention provides a composite padding material for use in bedding, garments or the like, said material comprising a filler layer of feathers or down and upper and lower plies of fibrous wadding over the opposite surfaces of said layer so that the barbs of outer feathers in the filler layer interlace with adjacent fibers in the wadding.

A better understanding of the present invention will be had upon reference to the accompanying drawings which illustrate some preferred embodiments of a composite padding material according to the invention by way of examples and in which.

Figure 1:
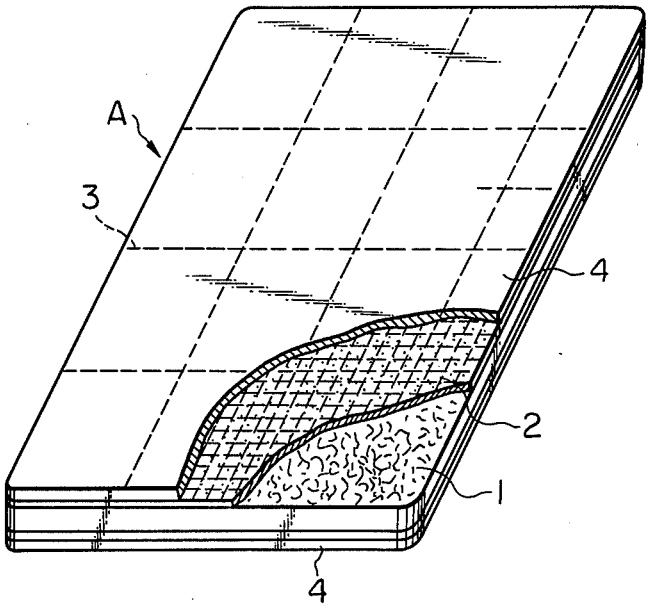
FIG. 1 is a perspective view of an embodiment of the composite padding material according to the present invention with parts broken away for the purpose showing the details of the arrangement thereof.
Figure 2:
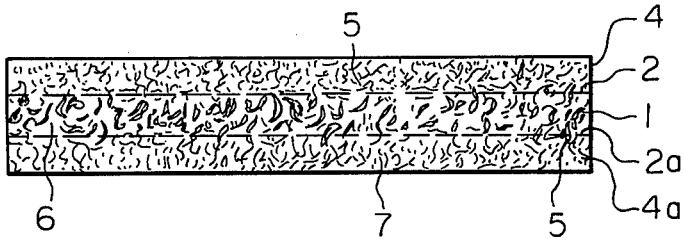
FIG. 2 is a section of the composite padding material shown in FIG. 1.

Referring now to FIGS. 1 and 2, there is shown a preferred embodiment of the composite padding material according to the present invention.

A filler layer 1 consists of feathers which are evenly arranged therein. Plies 2,2*a* of relatively coarse cloth such as non-woven cotton cloth, lawn, or a network of interconnected strands are applied to opposite surfaces of the filler layer as intermediate layers. Upper and lower wadding layers 4,4*a* of woolen fibers are superimposed on the intermediate layers. In this manner, these components are rendered integral to form a composite padding material A by woolen fibers of the wadding layers interlacing with barbs of the feathers which project through the coarse cloth intermediate layers. If necessary, the composite padding may be quilted at 3 in a network or terraced pattern to fix each component in place.

The present invention involves an arrangement of such composite padding material wherein the barbs 5 of the feather which project through the coarse cloths are entwined with woolen fibers and the coarse cloths are firmly held and settled by the woolen fiber wadding layers. With this arrangement, the composite padding material of the present invention eliminates uneven distribution of the feathers or lumping in blocks and insures prevention of projection of the feathers out of the covering when used in bedding or garments. To this end, barbs 5 of the outer feathers and woolen fibers are arranged over the coarse cloths 2,2*a* to be interlaced with each other to provide spaces 6 therebetween whereas the other ends of the outer feathers serve as free ends to loosely engage the adjacent inner feathers so that the feathers are maintained in position. Further, the woolen fibers are interlaced with the coarse cloth and in a uniform layer whereas the feathers are inherently moisture releasing. Thus the feathers are capable of moisture discharge and of variation in configuration such as shrinking, curving, and extension in response to moisture or heat transmitted through the woolen layers. In this manner, the combination of the woolen fibers and feathers may result in a synergistic action to provide better adiabatic effect with light weight, soft feeling, and moisture protection.

Figure 3:
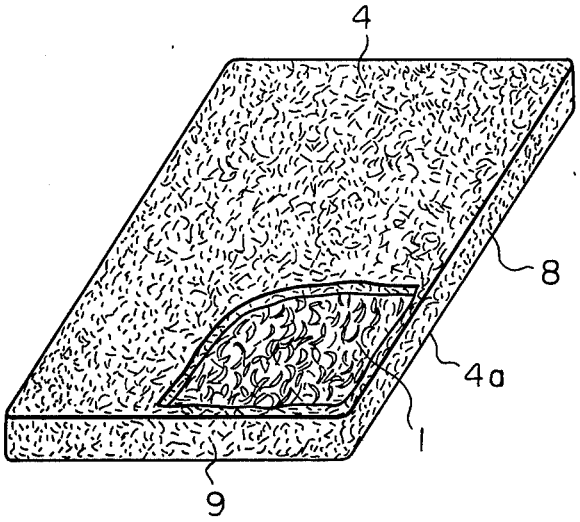
FIG. 3 is a perspective view of another embodiment of the padding material according to the present invention with parts broken away.
Figure 4:
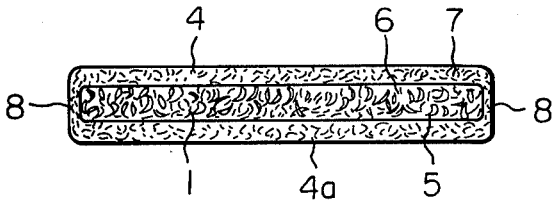
FIG. 4 is a section of the major part of the padding material shown in FIG. 3.

Referring to FIGS. 3 and 4, there is shown another preferred embodiment.

Feathers are used for a filler layer 1, the opposing surfaces of which are covered with upper and lower plies 4,4*a* of non-woven cloth or wadding of natural or artificial fibers such as cotton, silk, linen, wool, rayon or synthetic fibers, for example, vinylon, nylon, polyacryl, polypropylene, or polyester laminated on the filler layer. The padding layer 1 is also provided with closures 8 and 9 of non-woven cloth or wadding as in the upper and lower plies to associate therewith and so to cover the padding layer peripherally.

Figure 5:
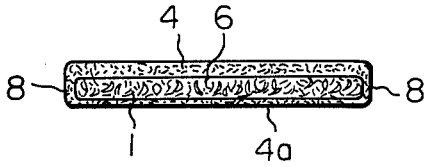
FIG. 5 is a section of the major part of further embodiment of the present invention.

In a further embodiment of the present invention shown in FIG. 5, the padding material is constructed with one ply greater in thickness than the other ply and the filler layer is held therebetween. More specifically, the upper ply 4 is made thicker whereas the lower ply 4*a* is thinner but still has a thickness enough to prevent the feathers from projecting therethrough. To this end, barbs 5 of the feathers and fibers 7 of the wadding are arranged to be even with each other. If desired, a needle punch may be used to fix the padding material in place.

The padding material presently employed according to the present invention relies on a filler layer entirely covered with non-woven cloth or wadding to facilitate production.

If this padding material is used in a sleeping bag in which a person shifts while sleeping, the feathers do not intertwine with one another thus preventing them not only from projecting from the covering but also from gathering in lumps or toward some area without requiring any cover quilting since all the fibers and the barbs are well arranged with one another. Also, the barbs of outer feathers are well interlaced with the fibers and the other ends of the outer feathers serve as free ends and in turn loosely engage with adjacent inner feathers to provide spaces 6. This enables the feathers to be fixed in position. Further, the fibers are in a uniform ply whereas the feathers are inherently moisture releasing. Thus the feathers are capable of moisture discharge and of variation in configuration such as shrinking curving, and extension in response to moisture or heat transmitted through the covering to the feathers. For this reason, the feathers are well adapted for thermal insulation, moisture protection and well feeling. In this manner, the combination of the fibers and feathers may result in a synergistic action to provide better adiabatic effect with light weight, soft feeling, and moisture protection than prior art materials having a similar purpose. Therefore, the present padding material is of great utility by the users.

The foregoing detailed description is given for clearness of understanding only, and no unnecessary limitations should be understood therefrom, as modifications will be obvious to those skilled in the art.

What is claimed is:

1. A composite padding comprising three substantially separate layers, an intermediate one of the layers being comprised of feathers having barbs and the intermediate layer of feathers having opposite surfaces, and respective outer layers adjacent the opposite surfaces of the intermediate layer, the outer layers being waddings of fibers, the barbs of the outer feathers projecting from the opposite surfaces of the intermediate layer and interlacing with fibers in the waddings of the outer layers.

2. The composite padding of claim 1, further comprising coarse cloths interposed between the intermediate and outer layers at the opposite surfaces of the intermediate layer, the barbs of the outer feathers projecting through the coarse cloths.

3. The composite padding of claim 1, wherein the fibers in the waddings comprise woolen fibers.

4. The composite padding of claim 1, wherein the outer wadding layers have peripheral portions interconnecting the outer layers along their peripheries and enclosing the intermediate layer about its periphery.

5. The composite padding of claim 4, wherein the outer wadding layers are non-woven fibrous webs.

* * * * *